United States Patent [19]

Van Laar

[11] Patent Number: 4,821,801

[45] Date of Patent: Apr. 18, 1989

[54] PRODUCING ASPHALTIC CRUDE OIL

[75] Inventor: Hermanus G. Van Laar, Calgary, Canada

[73] Assignee: Shell Oil Company, Houston, Tex.

[21] Appl. No.: 68,378

[22] Filed: Jun. 30, 1987

[30] Foreign Application Priority Data

Jun. 30, 1986 [CA] Canada ..... 512753

[51] Int. Cl.[4] ..... E21B 43/00

[52] U.S. Cl. ..... 166/250; 166/370; 166/304

[58] Field of Search ..... 166/250, 369, 370, 50, 166/304, 252; 73/151

[56] References Cited

U.S. PATENT DOCUMENTS

| | | | |
|---|---|---|---|
| 2,385,298 | 9/1945 | Muskat | 166/1 |
| 2,434,239 | 1/1948 | Zublin | 166/369 X |
| 2,452,920 | 11/1948 | Gilbert | 255/1.6 |
| 4,033,410 | 7/1977 | Kauffman | 166/244 C |
| 4,183,407 | 1/1980 | Knopik | 166/314 |
| 4,257,650 | 3/1981 | Allen | 166/50 X |
| 4,350,600 | 9/1982 | Sharp et al. | 252/8.55 E |
| 4,410,216 | 10/1983 | Allen | 166/50 X |
| 4,436,165 | 3/1984 | Emery | 175/61 |
| 4,653,583 | 3/1987 | Huang et al. | 166/50 X |

FOREIGN PATENT DOCUMENTS 346777 of 1978 Austria .

OTHER PUBLICATIONS

Deul et al., "Degasification of Coalbeds—A Commercial Source of Pipeline Gas", *American Gas Association Monthly*, vol. 56, No. 1, Jan. 1974, pp. 4-6.

Hamby, Jr., T. W., et al., "Producing Mississippi's Deep, High—Pressure Sour Gas", *Journal of Petroleum Technology, Jun. 1976, pp. 629-638.*

*Primary Examiner*—Bruce M. Kisliuk

[57] ABSTRACT

An asphaltic crude oil is produced via a well system comprising a horizontal drainhole section extending through the reservoir formation. Formation plugging due to in-situ precipitation of asphalt during production operations is avoided by adequately sizing the horizontal drainhole section in the resevoir, thereby establishing near-wellbore pressures in the reservoir above the asphalt saturation pressure, without sacrificing production rates.

5 Claims, 2 Drawing Sheets

1
2
3
4
5
6
7
I
II
h
L

PRODUCING ASPHALTIC CRUDE OIL

BACKGROUND OF THE INVENTION

The invention relates to the production of asphaltic crude oil. More particularly, it relates to a method of producing an asphaltic crude oil from a subterranean reservoir formation while preventing plugging of the reservoir formation due to in-situ precipitation of asphalt.

Crude oil is able to hold asphalt in solution. The amount of asphalt a crude oil can dissolve depends on its composition, temperature, and pressure.

Formation plugging due to in-situ precipitation of asphalt is a problem of producing asphaltic crude with a near-saturation asphalt content. The asphalt comes out of solution when the pressure of the reservoir fluid drops below the asphalt precipitation or asphalt saturation pressure. Such a drop in pressure occurs when the oil is produced in a conventional, vertical well. Due to the inherent, inevitably high pressure draw-downs required to produce at commercial rates, the reservoir pressure in the proximity of the wellbore easily drops below the asphalt saturation pressure, creating conditions favorable for in-situ precipitation of asphalt.

Furthermore, the fluid pressure is further reduced while passing through the geobaric gradient on the way to the surface. Provided the wellbore pressure remains above the bubble point pressure, further precipitation and subsequent deposition in the well tubulars takes place. However, if the wellbore pressure drops below the bubble point pressure, no further precipitation of asphalt within the wellbore takes place.

Preventive and remedial methods have been developed and routinely used in field operations to cope with the problem of asphalt deposition in well tubulars. However, no practical, effective methods exist which prevent or remove asphalt deposits formed in the reservoir.

SUMMARY OF THE INVENTION

An object of the invention is to provide a method of producing asphaltic crude oil, wherein asphalt deposition in the reservoir and in the well bore traversing the payzone is avoided without sacrificing production rates.

In accordance with the invention this object is accomplished by an asphaltic crude oil production method wherein a well system is drilled and completed into a reservoir formation in which fluid pressure is above asphalt precipitation pressure, which system comprises a substantially vertical well section extending from the reservoir formation to the surface and a substantially horizontal drainhole section traversing the reservoir formation along a predetermined distance.

The length of said drainhole section is sized in conjunction with a desired production rate of the well system and the difference $\Delta P$ between the reservoir pressure and said asphalt precipitation pressure.

Crude oil production is established at said desired production rate after completing the well system.

Instead of providing the well system with a single substantially horizontal drainhole section it may be provided with a plurality of substantially horizontal drainhole sections as well.

BRIEF DESCRIPTION OF THE DRAWINGS

The invention will now be explained in more detail with reference to the accompanying drawings in which.

DETAILED DESCRIPTION OF THE PREFERRED EMBODIMENT

Figures 1A, 1B:
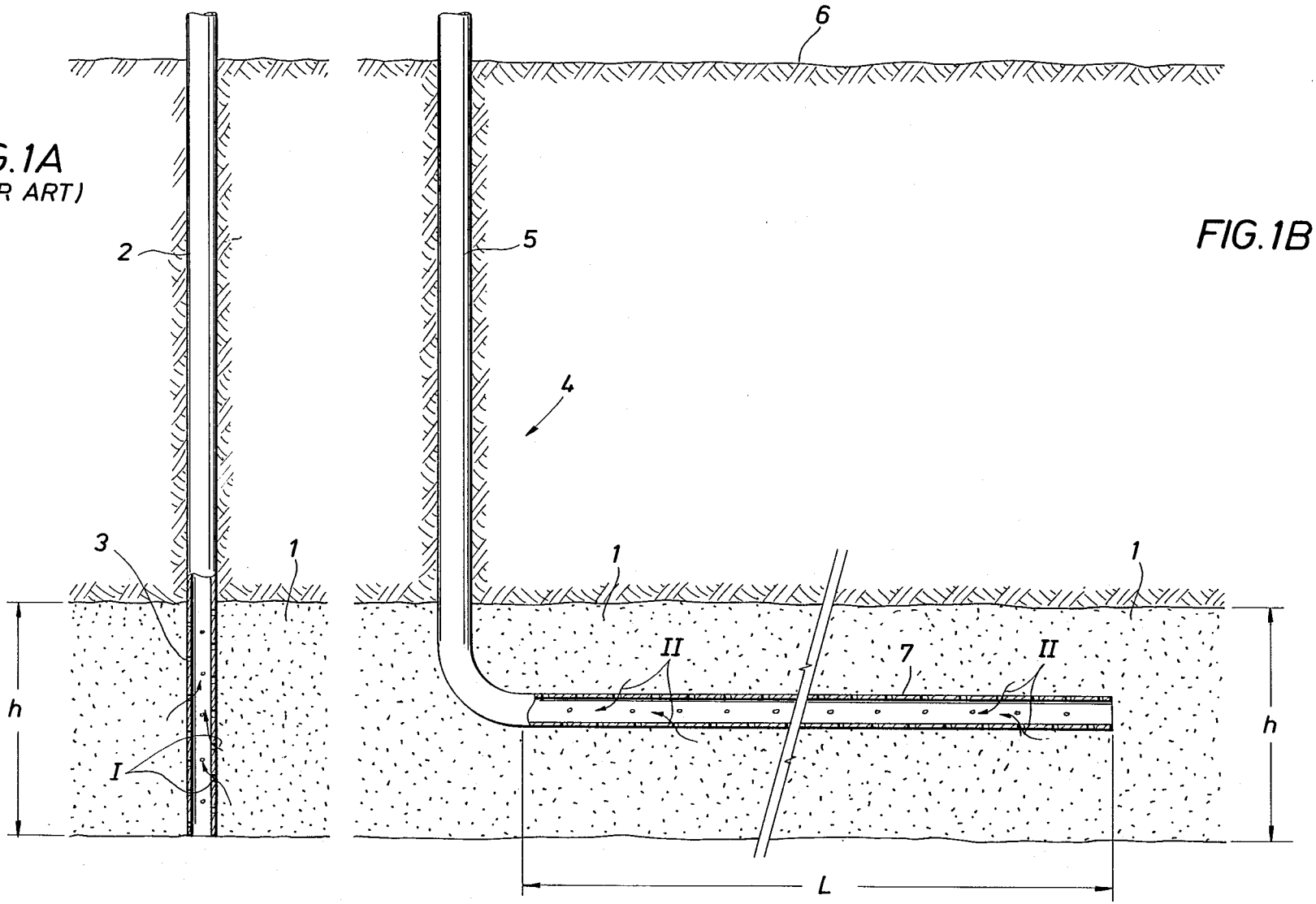
FIG. 1A (PRIOR ART)
FIG. 1*a* shows a conventional asphaltic crude oil producing well and FIG. 1*b* shows a well system comprising a substantially horizontal drainhole section producing from the same reservoir formation.

In FIGS. 1*a* and 1*b* there is shown a subterranean asphaltic crude oil containing reservoir formation 1 with an average thickness h and having substantially horizontal upper and lower exterior boundaries.

In FIG. 1*a* there is shown a conventional, vertical well 2 traversing the reservoir formation 1 in a substantially orthogonal direction thereby forming an inflow region 3 extending along the thickness of the reservoir formation 1. During production, crude oil flows via the permeable wall of the well bore at the inflow region 3 from the reservoir formation 1 into the well 2 as illustrated by arrows I.

In FIG. 1*b* there is shown a well system 4 according to the invention traversing the same reservoir formation 1. The well system 4 comprises a vertical well section 5 extending from the earth surface 6 into the reservoir formation 1, a deviated section leading to a substantially horizontal drainhole section 7.

The drainhole section 7 has a length L and comprises a permeable wellbore wall via which asphaltic crude oil flows (see arrows II) from the reservoir formation 1 into the well system 4.

As will be explained hereinbelow, the length L of the permeable drainhole section 7 in the reservoir formation 1 is an important parameter with regard to avoiding in-situ precipitation of asphalt in the pores of the reservoir formation in the proximity of the well bore.

Laboratory investigations demonstrated the effect of pressure on the solubility of asphalt in a North Sea crude oil. The results indicated that at pressures above the bubble point, the solubility of asphalt in crude oil decreases with pressure as shown below:

n-HEPTANE ASPHALT CONTENT AS A FUNCTION OF PRESSURE AT 121° C.

| Pressure Bar | Asphalt Content mg/kg |
|---|---|
| 400 | 7 200 |
| 300 | 4 300 |
| 200 | 2 300 |

It may be seen that a pressure drop from 300 to 200 bar reduces the asphalt solubility in crude from 4300 to 2300 mg/kg, causing the precipitation of 2000 mg/kg.

In production operations, this implies that significant amounts of asphalt are precipitated in the produced fluid; depending on the distribution and severity of the pressure reduction throughout the flow circuit, asphalt deposition is possible in the formation and/or wellbore. The quantities of asphalt which could potentially precipitate are significant. For instance, in a well producing 1000 $m^3$ per day of oil, 600 kg per day of asphalt can precipitate as a result of an isothermal drop in pressure from 300 to 266 bar. If this drop in pressure occurs in the reservoir, in-situ asphalt precipitation is likely to occur. Because most of the reservoir pressure reduction during production takes place in the near-wellbore region, the same region experiences the majority of the in-situ asphalt deposition. Not only can this reduce production, but in extreme cases, it can permanently shut off flow into the wellbore, leading to either rexpensive remedial treatments or complete abandonment and the drilling of a replacement well.

In-situ precipitation of asphalt in a producing formation is controlled by the difference between the pressure deep in the reservoir, i.e., at the exterior boundary of the reservoir, ($P_e$) and that in the borehole during production ($P_b$). This pressure difference, commonly called "draw-down" $\Delta P$, is a function of the well, fluid and rock characteristics and can be derived from Darcy's Law for the radial flow of incompressible fluids. For a vertical well, the following equation is applicable:

$$\Delta P_v = \frac{Q \cdot \mu \cdot \ln \frac{r}{r^e}}{2 \cdot \pi \cdot K \cdot h} \quad (1)$$

Where:

$P_v = P_e - P_{bv}$ = Draw-down, vertical hole, bar
$P_e$ = Reservoir pressure at the exterior boundary, bar
$P_{bv}$ = Borehole pressure, vertical hole, bar
Q = Oil production rate, $cm^3$/sec
$\mu$ = Viscosity of oil under reservoir conditions, cP
K = Rock permeability, D
h = Net formation thickness, cm
$r_e$ = Radius of exterior boundary, cm
$r_w$ = Wellbore radius, cm In case the draw-down exceeds the difference between the reservoir pressure and the asphalt saturation pressure, precipitation of asphalt takes place in the formation.

In the following example, it is assumed that the pressure of a given asphaltic crude oil reservoir is 320 bar (temperature 121° C.) and the asphalt saturation pressure of the crude is 300 bar. In-situ asphalt precipitation will take place when the pressure draw-down exceeds 20 bar. It is further assumed:

| | |
|---|---|
| Net formation thickness, | h = 30 m |
| Radius of exterior boundary, | $r_e$ = 400 m |
| Wellbore radius, | $r_w$ = 0.11 m |
| Formation permeability, | K = 150 mD |
| Oil viscosity, | $\mu$ = 1 cP |

To achieve commercially acceptable crude production rates (say 1000 $m^3$/d) from a vertical well drilled in this reservoir (see FIG. 1), draw-downs of at least 34 bar are required. As this causes the near-wellbore pressure in the reservoir to drop significantly below the saturation pressure, in-situ asphalt precipitation will take place.

Based on equations used by Giger et al (Giger F. M., Reiss L. H. and Jourdan A. P., "The Reservoir Engineering Aspects of Horizontal Drilling," S.P.E. 13024, September 1984) for estimating the productivity of horizontal wells, the following relationship between the draw-down and the various well, fluid, and rock characteristic can be derived for the inflow of crude oil from the formation into the horizontal drainhole section 7:

$$\Delta P_h = \frac{Q\mu}{2\pi KL}\left[\frac{L}{h}\ln\left(\frac{1+\sqrt{1-\left(\frac{L}{2r_e}\right)^2}}{\frac{L}{2r_e}}\right)+\ln\frac{h}{2\pi r_w}\right] \quad (2)$$

Where:

$\Delta P_h$ = Draw-down, horizontal hole, bar
L = Length of horizontal section of hole, cm In the following example, a 450 m horizontal well is considered, assuming the same formation, fluid and well characteristics as for the vertical well example.

Under the assumed well conditions, the draw-down for the horizontal hole is calculated to be only 6 bar; this implies a near-wellbore pressure in the reservoir of 314 bar, 14 bar above the asphalt saturation pressure.

In order to easily compare the pressure draw-down of a vertical well with that of a horizontal well producing at the same rate from the same reservoir, the ratio of equations (1) and (2) is simplified to equation (3):

$$\frac{\Delta P_v}{\Delta P_h} = \frac{\ln\frac{r_e}{r_w}}{\ln\left(\frac{1+\sqrt{1-\left(\frac{L}{2r_e}\right)^2}}{\frac{L}{2r_e}}\right)+\frac{h}{L}\ln\frac{h}{2\pi r_w}} \quad (3)$$

Figure 2:
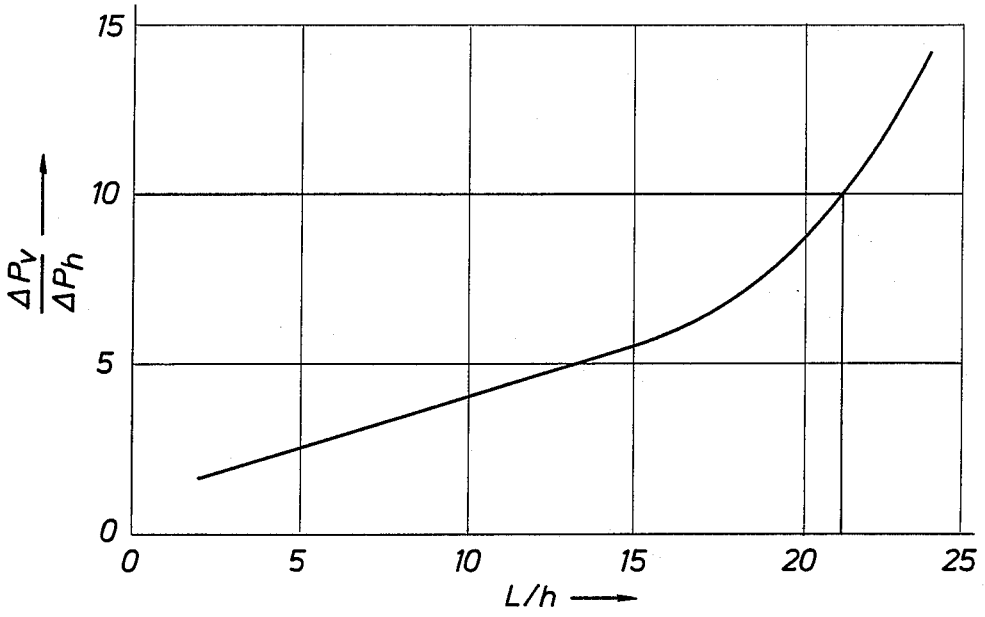
FIG. 2 shows a diagram in which the ratio ($\Delta P_v/\Delta P_h$) of the pressure draw-down of a crude oil flowing into the vertical well and that of the crude oil flowing into the horizontal drainhole is plotted against the dimensionless horizontal length (L/h) of the drainhole.

Equation (3) shows that for a given reservoir where $P_e$, $r_e$, h and $r_w$ remain the same and Q is not changed, the pressure draw-down for a horizontal hole decreases as the horizontal length L increases. The effect of L on the draw-down is illustrated in FIG. 2 where the draw-down ratio $\Delta P_v/\Delta P_h$ is plotted as a function of the dimensionless horizontal length (L/h). Graphs like this can be used to estimate the minimum length of the horizontal section required to achieve a given maximum allowable draw-down.

FIG. 2 further illustrates that the horizontal wellbore length L in the reservoir is the dominating parameter with regard to establishing minimum draw-down; and that under the assumed well conditions, a horizontal hole 20 times longer than the reservoir thickness exhibits pressure draw-downs ten times less than those in a vertical hole through the same reservoir, producing at the same rate.

By extending the horizontal length of a drain hole, it is not only possible to avoid in-situ asphalt separation , but also to achieve this at increased production rates. By applying equation (2) with the assumed well and reservoir conditions, it can be demonstrated that if the horizontal hole length is extended by about 25%, the production rate can be increased by about 30% at the same draw-down.

Figure 3:
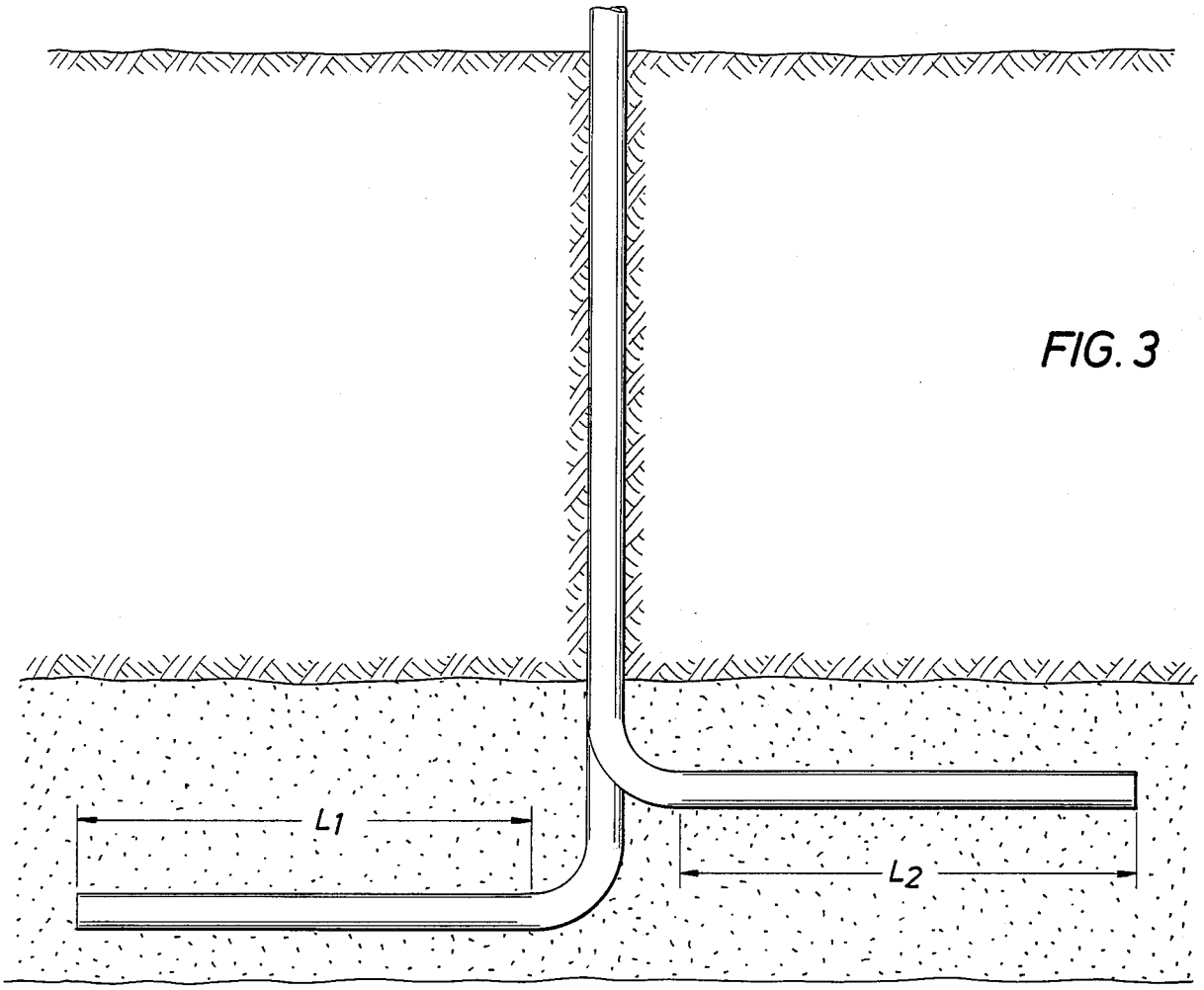
FIG. 3 shows an asphaltic crude oil producer well system comprising two horizontal drainhole sections drilled from a single vertical well section.

Furthermore, as illustrated in FIG. 3, modern horizontal well drilling techniques enable operators to drill more than one horizontal hole from a single vertical well. This can be considered as an alternative if further extension of a single horizontal well is desirable, but technically not possible. The total production capacity of the well system is controlled by the sum of the lengths $L_1$ and $L_2$ of both horizontal sections.

This all implies that from a single horizontal well system, considerably higher production rates are possible than from a single vertical well without inducing in-situ asphalt separation.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A method of producing asphaltic crude oil from a subterranean reservoir formation in which the reservoir pressure at the exterior boundary of the reservoir is above the asphalt saturation pressure, the method comprising:

determining the asphalt saturation pressure at the reservoir temperature of the crude oil to be produced;

completing a well system into said formation, said well system comprising a substantially vertical well section extending from the reservoir formation to the surface and a substantially horizontal drainhole section traversing the reservoir formation along a predetermined length, said length being sized in conjunction with a desired crude oil production rate and the difference $\Delta P$ between the reservoir pressure and said asphalt saturation pressure to prevent asphalt precipitation;

establishing crude oil production via the well system at said desired production rate.

2. A method in accordance with claim 1, wherein said step of sizing the length (L) of the drainhole section comprises:

first determining a maximum acceptable difference $\Delta P$ between the reservoir pressure at the exterior boundary of the reservoir ($P_e$) and that the interior of the drainhole section ($P_{bh}$) to maintain the fluid pressure ($P_{bh}$) in said interior above the asphalt saturation pressure:

subsequently calculating the difference $\Delta P_h$ between $P_e$ and $P_b$ for various values of said length (L) of the drainhole section on the basis of the relationship:

$$\Delta P_h \doteq \frac{Q\mu}{2\pi KL}\left[\frac{L}{h}\ln\left(\frac{1+\sqrt{1-\left(\frac{L}{2r_e}\right)^2}}{\frac{L}{2r_e}}\right)+\ln\frac{h}{2\pi r_w}\right]$$

Where:

$\Delta P_h = P_e - P_{bh}$, bar $P_e$ = Reservoir pressure at the exterior boundary, bar $P_{bh}$ = Borehole pressure, horizontal drainhole, bar L = Length of the horizontal drainhole section, cm Q = Desired crude oil production rate, $cm^3/sec$ $\mu$ = Viscosity of crude oil under reservoir conditions, cP K = Rock permeability, D h = Net formation thickness, cm $r_e$ = Radius of exterior boundary, cm $r_w$ = Well bore radius, cm and then determining a length (L) for which $\Delta P_h < \Delta P$.

3. A method in accordance with claim 2 wherein the length of the substantially horizontal drainhole section is at least 20 times the reservoir thickness.

4. The method of claim 1, wherein the well system comprises a single substantially vertical well section and a plurality of substantially horizontal drainhole sections arranged in fluid communication with the vertical well section and traversing the reservoir formation in various directions.

5. The method of claim 4, wherein the accumulated lengths of said substantially horizontal drainhole sections is at least 20 times the thickness of the reservoir formation.

* * * * *